US005185947A

United States Patent [19]

Thompson et al.

[11] Patent Number: 5,185,947

[45] Date of Patent: Feb. 16, 1993

[54] LINE-GUIDE ADVANCEMENT MECHANISM FOR COPYHOLDERS

[76] Inventors: David B. Thompson; Linda L. Thompson, both of 19981 Pleasant Park Rd., Conifer, Colo. 80433

[21] Appl. No.: 737,191

[22] Filed: Jul. 29, 1991

[51] Int. Cl.[5] ..... B41J 11/64

[52] U.S. Cl. ..... 40/355; 40/356; 74/138

[58] Field of Search ..... 74/138, 142, 141.5; 40/352, 353, 355, 356; 192/47, 75, 76, 45; 400/718

[56] References Cited

U.S. PATENT DOCUMENTS

| | | | |
|---|---|---|---|
| 303,089 | 8/1884 | White | 192/45 X |
| 375,425 | 12/1887 | Parkinson et al. | 40/356 |
| 399,503 | 3/1889 | Dean . | |
| 415,550 | 11/1889 | McIntire . | |
| 469,658 | 2/1892 | Chapman . | |
| 595,140 | 12/1897 | Brooks | 40/356 |
| 601,112 | 3/1898 | Woodruff . | |
| 678,541 | 7/1901 | Coffey . | |
| 679,302 | 7/1901 | Edwards . | |
| 679,386 | 7/1901 | Lawton . | |
| 716,790 | 12/1902 | Towers et al. | 40/353 |
| 1,033,288 | 7/1912 | Stavens | 40/356 |
| 1,044,574 | 11/1912 | Roberts et al. | 40/356 |
| 1,104,100 | 7/1914 | Brown | 40/356 |
| 1,170,941 | 2/1916 | Strause | 40/356 |
| 1,245,027 | 10/1917 | Rhoads . | |
| 1,709,188 | 4/1929 | Ostdiek et al. . | |
| 1,758,657 | 5/1930 | Fensky et al. . | |
| 1,768,753 | 7/1930 | Fensky et al. | 40/356 |
| 1,800,071 | 4/1931 | Hevenor | 40/356 |
| 1,905,834 | 4/1933 | Fensky | 40/356 |
| 2,115,331 | 4/1938 | Ford . | |
| 2,206,961 | 7/1940 | Israel | 40/354 |
| 2,217,127 | 10/1940 | Metcalf . | |
| 2,283,493 | 5/1942 | Dickinson et al. . | |
| 2,642,841 | 6/1953 | Funk | 40/354 |
| 2,906,242 | 9/1959 | Greenberg | 40/356 |
| 3,030,924 | 4/1962 | Friis-Hansen . | |
| 4,762,332 | 8/1988 | Seol | 74/142 X |
| 4,770,115 | 9/1988 | Gillum | 116/235 |

*Primary Examiner*—James R. Brittain
*Assistant Examiner*—J. Bonifanti

[57] ABSTRACT

A line-guide advancement mechanism for copyholders of the type for holding a document containing information to be transcribed and containing a linearly moveable line-guide for highlighting individual lines of information. The line-guide advancement unit is structured to be able to fixably attach to an existing copyholder (10) and a line-guide (46). The unit contains a drive mechanism (12) and an operator's foot pedal (20) which provide step-wise movement to the line-guide (46). The drive mechanism (12) can be adjusted via a knob (36) and vernier scale (74) to provide a wide range of spacings in the movement of the line-guide.

8 Claims, 4 Drawing Sheets

EXPLODED VIEW

EXPLODED VIEW

EXPLODED VIEW

EXPLODED VIEW

PLAN VIEW

PLAN VIEW

EXPLODED VIEW

LINE-GUIDE ADVANCEMENT MECHANISM FOR COPYHOLDERS

BACKGROUND

1. Field of the Invention

This invention relates to copyholders, specifically to an improved line-guide advancement mechanism for a copyholder.

2. Discussion of Prior Art

This invention was the subject matter of Patent Office Disclosure Document No. 268967 filed Dec. 10, 1990.

Heretofore, line-guide advancement mechanisms for copyholders have had various operational and structural disadvantages which limited their usefulness and commercial viability. The copyholder having an integral line-guide advancement mechanism is already known as it is disclosed in U.S. Pat. No. 375,425 to Parkinson & Locke (1887). Several other attempts have been made to design line-guide advancement mechanisms that are simple, compact, reliable, easy to use and commercially feasible. As the cited reference Patents show, many useful improvements in the design of line-guide advancement mechanisms have been recognized; however, none of these have achieved their common purpose: to become an essential part of the daily lives of those persons whose activities include transcribing information from written, typed or printed documents.

All of the line-guide advancement mechanisms heretofore known suffer from some or all of a number of disadvantages:

(a) The mechanism used to cause and control line-guide advancement is complex, requiring a multiplicity of contiguous items to produce a simple, step-wise movement.

(b) The operator's control oftentimes requires the use of one or more hand actions away from the transcribing apparatus during transcription thereby reducing operator efficiency.

(c) The mechanism used offers a limited range of spacing selection in the step-wise movement of the line-guide or offers only a discrete set of spacings. Either of these choices limits the mechanism's usefullness over the wide disparity of line spacings encountered in written, typed and printed documents.

(d) Their manufacture requires extensive machine tool set-ups and, even when manufactured in cost-effective lot sizes, carry a heavy economic burden.

(e) The assembly, alignment, proof testing and maintenance of the total assembleage are labor intensive and require mechanical skills beyond those which can be expected in the average user.

(f) All cited references rely upon a copy-holding frame or platen which forms an integral portion of the line-guide advancement mechanism. Without this integral frame or platen, the mechanism cannot perform its intended function.

OBJECTS AND ADVANTAGES

Accordingly, several of the objects and advantages of our invention are:

(a) to provide a simple, compact drive mechanism comprising less than twenty total parts which in concert will produce a simple, step-wise movement of the copyholder's line-guide;

(b) to provide an operator's control which does not require hand actions away from the transcribing apparatus during transcription, thereby increasing the efficiency of operation;

(c) to provide a very wide range of spacing selection in the step-wise movement of the copyholder's line-guide to fully cover the wide disparity of line spacings encountered in written, typed and printed documents;

(d) to provide a mechanism whose parts require minimal machine tool and assembly set-ups to minimize the overall economic burden;

(e) to provide a mechanism whose total assembleage can be assembled, aligned, proof tested and maintained with ease and minimal mechanical skills, thereby lessening direct labor and user burden;

(f) to provide a copyholder line-guide advancement mechanism which can be readily adapted to copyholders already existing in the office environment thereby minimizing the expense to the user and maximizing the utility of the mechanism;

(g) to provide a simple, reliable and easy to use mechanism that will solve the problem of visually keeping track of the information contained on a written, typed or printed document.

Still further objects and advantages will become apparent from a consideration of the ensuing description and drawings.

DRAWING FIGURES

REFERENCE NUMERALS IN DRAWINGS

Figure 1:
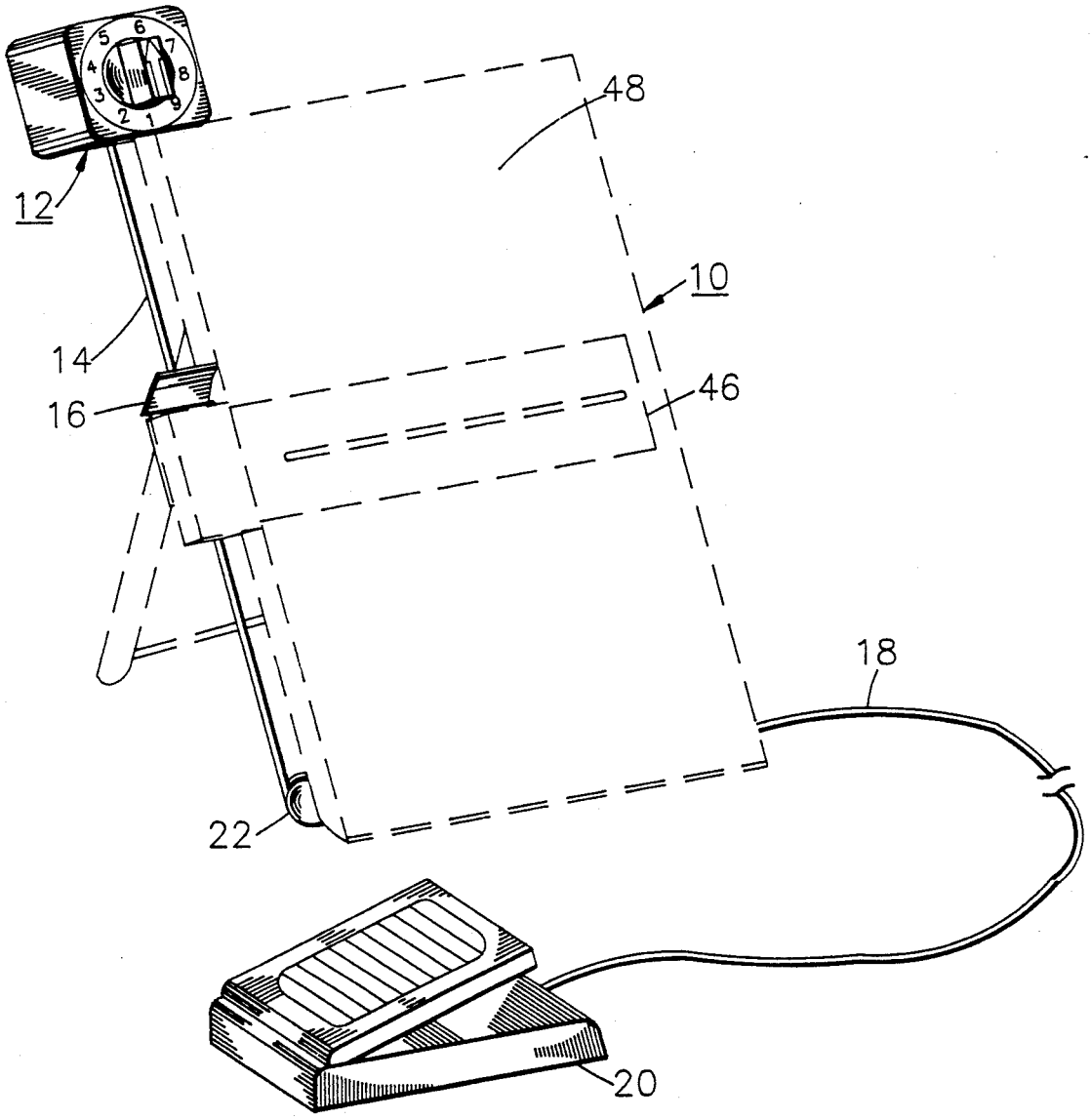
FIG. 1 is a perspective view of a basic version of our invention as it is installed on a copyholder.

| Reference Numerals In Drawings | |
|---|---|
| 10 | copyholder |
| 12 | drive mechanism |
| 14 | drive belt |
| 16 | release handle |
| 18 | push/pull cable |
| 20 | foot pedal |
| 22 | sheave |
| 24 | bracket |
| 26 | cover plate |
| 28 | housing |
| 30 | clutch spider |
| 32 | box |
| 34 | drum |
| 36 | knob |
| 38 | retaining ring |
| 40 | cable nut |

-continued

| Reference Numerals In Drawings | |
|---|---|
| 42 | cable washer |
| 44 | connecting tube |
| 46 | line-guide |
| 48 | platen |
| 50 | shaft |
| 52 | wire |
| 54 | radial groove |
| 56 | groove |
| 58 | hex shaft |
| 60 | hex hole |
| 62 | finger |
| 64 | flute |
| 66 | cavity |
| 68 | boss |
| 70 | hole |
| 72 | slot |
| 74 | scale |
| 76 | lever |
| 78 | hole |
| 80 | body |
| 82 | hinge spring |
| 84 | finger spring |

DESCRIPTION—FIGS. 1 TO 9

Figure 2:
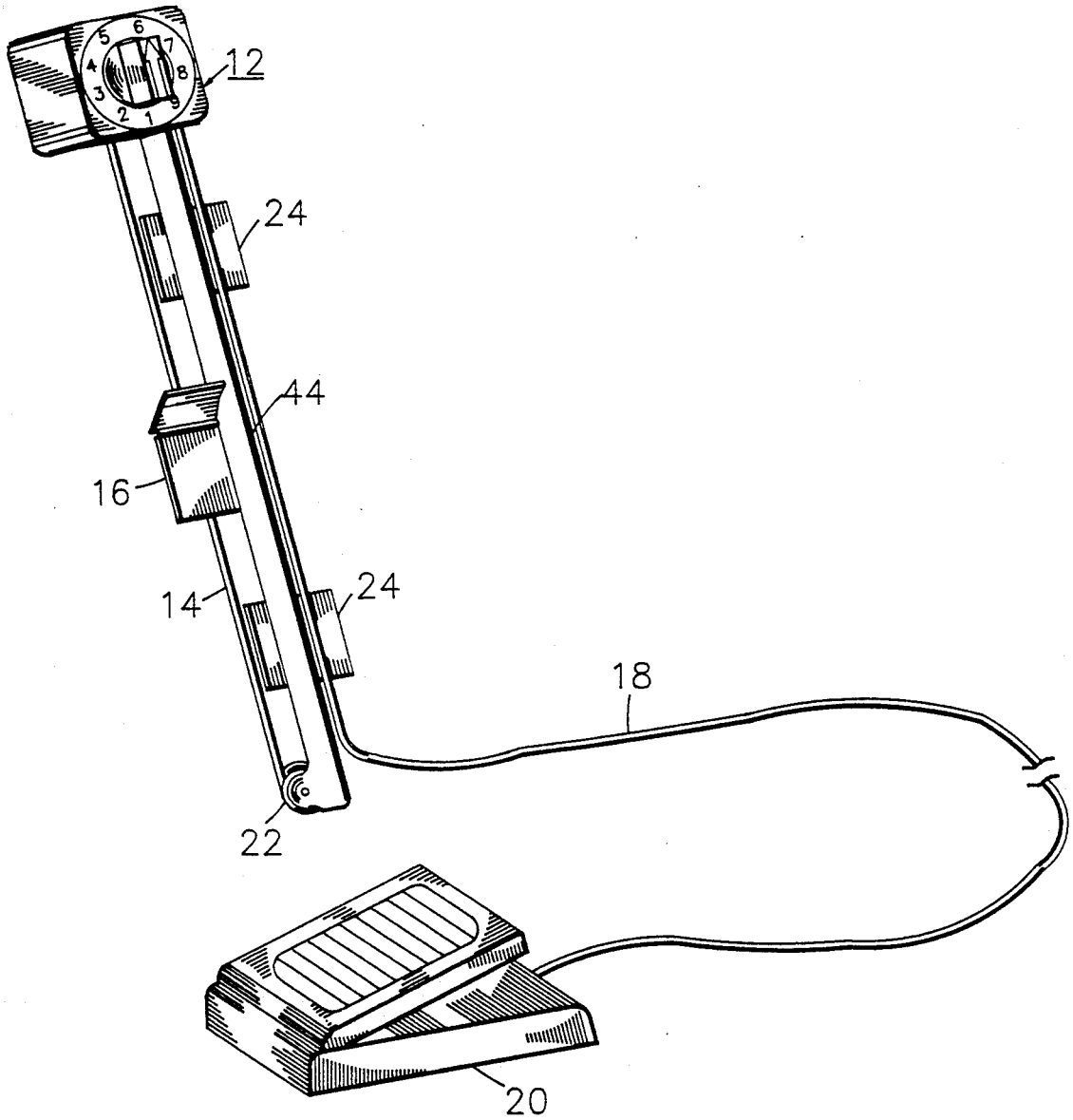
FIG. 2 is a perspective view of the same basic version of our invention prior to being installed on a copyholder.

A typical embodiment of the present invention is illustrated in FIG. 1 (perspective view, mounted on a copyholder 10) and FIG. 2 (perspective view, unmounted). The line-guide advancement device comprises a drive mechanism 12, a continuous, flexible drive belt 14, a release handle 16 which is fixably attached to a line-guide 46 member of copyholder 10. Drive belt 14 is mounted about a sheave 22 and through a connecting tube 44 to drive mechanism 12. Drive mechanism 12 is attached to a push/pull cable 18 and a foot pedal 20 arrangement. Connecting tube 44 acts to fixably connect sheave 22 and drive mechanism 12 and also, through the use of a pair of brackets 24, acts to mount the line-guide advancement device to the rearward side of a platen 48 member of copyholder 10. Brackets 24 also hold push/pull cable 18 fixably attached to platen 48 and connecting tube 44.

Figure 3:
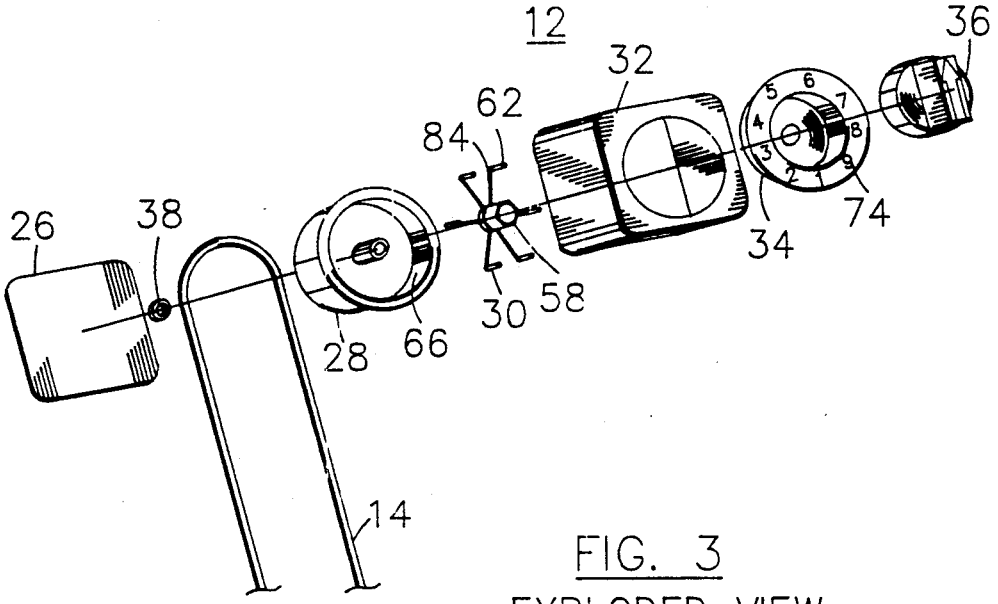
FIG. 3 is an exploded view in detail of the portion indicated by the reference numeral 12 in FIG. 1 and FIG. 2.
Figure 4:
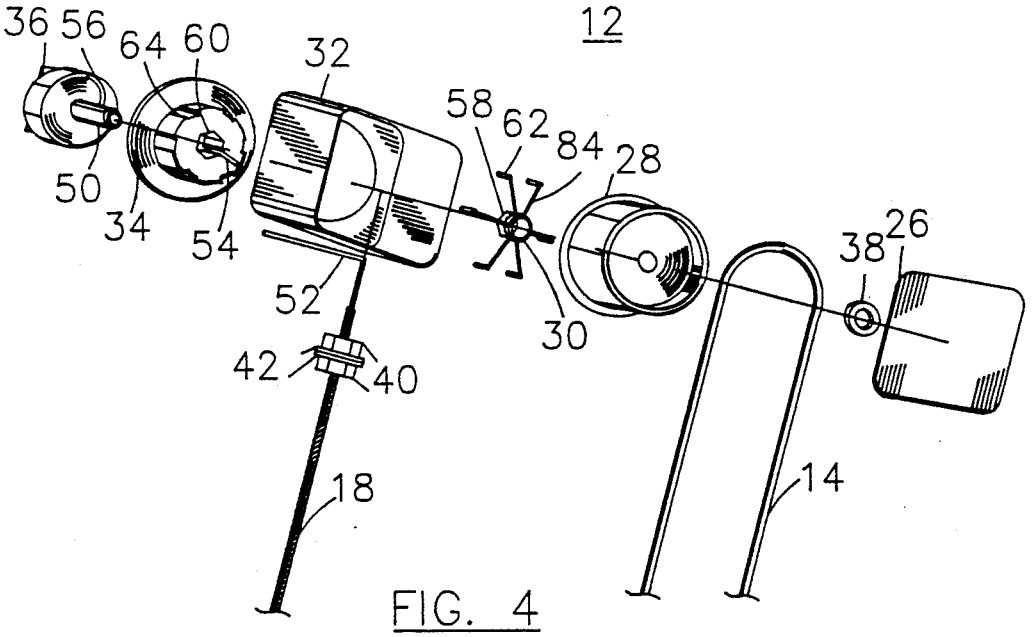
FIG. 4 is a reverse view of the detail shown in FIG. 3.

FIG. 3 and FIG. 4 show exploded views of the assembleage of drive mechanism 12. The general arrangement consisting of a knob 36, a drum 34, a box 32, a clutch spider 30, a housing 28, drive belt 14, a retaining ring 38 and a cover plate 26 may be easily seen in FIG. 3 and FIG. 4. Basically these parts are assembled as shown with retaining ring 38 fixing the parts together by engageably mounting onto a shaft 50 member of knob 36. A pair of cable nuts 40 and a pair of cable washers 42 are used to fixably attach push/pull cable 18 through the lower portion of box 32.

Figure 5:
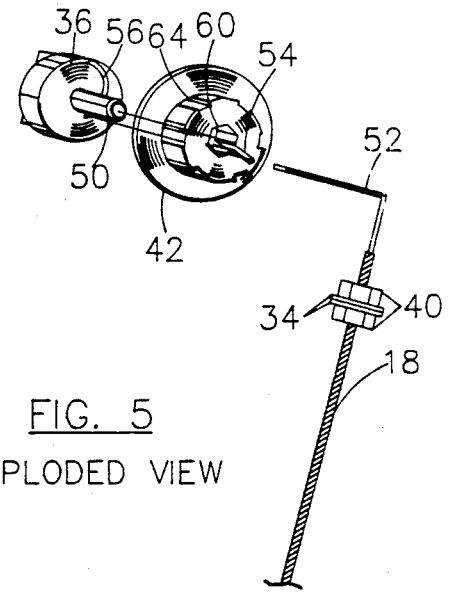
FIG. 5 is a partial view showing the assembly relationship of the items of FIG. 3 and FIG. 4 used to adjust the step-wise movement of the line-guide and the actuation thereof.
Figure 6:
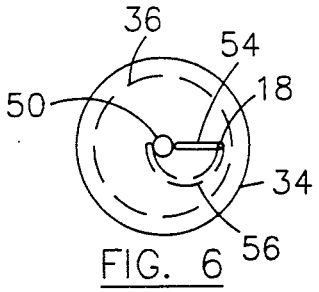
FIG. 6 is a plan view of the items shown in FIG. 5.

FIG. 5 and FIG. 6 show in detail that portion of the assembleage of drive mechanism 12 of FIG. 3 and FIG. 4 which is used to adjust the step-wise movement of the drive mechanism and the actuation thereof. FIG. 5 is an exploded view showing the relationship of knob 36, drum 34 and push/pull cable 18. The inner, cylindrical wire 52 member of push/pull cable 18 has a 90 degree bend which is introduced into a radial groove 54 in drum 34. Passing through radial groove 54, this 90 degree portion then enters a semi-circular groove 56 inscribed non-concentrically on a rearward surface of knob 36. FIG. 6 is a plan view, showing the relationship of knob 36, drum 34 and push/pull cable 18.

Figure 8:
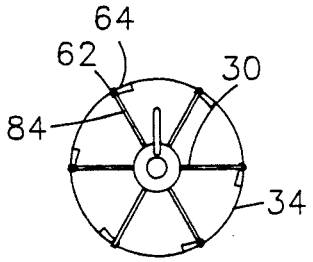
FIG. 8 is a plan view of the items shown in FIG. 7.
Figure 7:
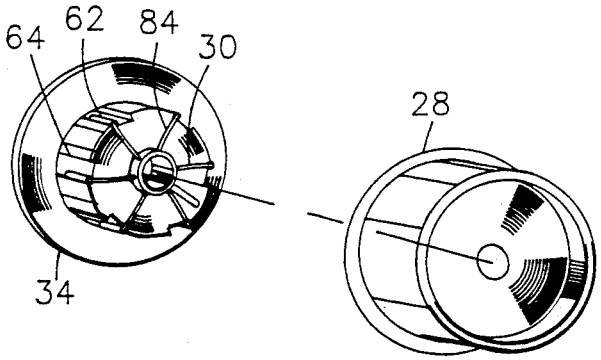
FIG. 7 is a partial view showing the assembly relationship of the items of FIG. 3 and FIG. 4 used to impart unidirectional movement to the copyholder's line-guide.

FIG. 7 and FIG. 8 show in detail that portion of the assembleage of drive mechanism 12 of FIG. 3 and FIG. 4 which is used to impart unidirectional movement to drive belt 14. FIG. 7 is an exploded view showing the relationship of drum 34, clutch spider 30 and housing 28. A hexagonal projection 58 of clutch spider 30 mounts into a matching hexagonal hole 60 in drum 34, whilst finger-like projections 62 of clutch spider 30 mount into flutes 64 on an outer annulus of drum 34. Clutch spider 30/drum 34 sub-assembly then is inserted into a close-fitting cavity 66 in housing 28. FIG. 8 is a plan view also showing the relationship of clutch spider 30 and drum 34.

Figure 9:
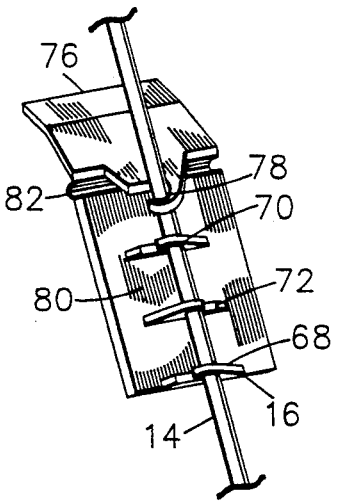
FIG. 9 is a perspective view showing in detail that portion of FIG. 1 and FIG. 2 used to attach to and impart movement to the copyholder's line-guide.

FIG. 9 is a perspective view showing the relationship of release handle 16 and drive belt 14. Release handle 16 contains four (4) rearwardly projecting bosses 68 each containing an axially aligned cylindrical hole 70 through which the cylindrical drive belt 14 passes. Rearwardly projecting bosses 68 of release handle 16 also contain a radial slot 72 through which to pass drive belt 14 when assembling the mechanism. Radial slots 72 are positioned on alternating sides of bosses 68 so that release handle 16 will be fixably mounted to drive belt 14.

OPERATION—FIGS. 1, 2, 6, 8, 9

The manner of using the line-guide advancement mechanism on a copyholder is similar to using a foot pedal actuated sewing machine. Much in the way fabric is positioned in a sewing machine and the sewing needle is brought to bear on the seam to be stitched, the document to be transcribed is placed on copyholder 10 and line-guide 46 is positioned to highlight the first line of interest. Also, to begin sewing, a selection, usually via a knob and vernier scale, is made as to the type of stitch and the stitch spacing. In the same way, the line-to-line spacing is selected via knob 36 and a numerical scale 74 on drum 34.

Once the above set-up is accomplished, either on a sewing machine or a copyholder with a line-guide advancement mechanism, the operator simply depresses a foot pedal to begin operation. In the case of the sewing machine the operation is usually continuous while the foot pedal is depressed. For the herein described line-guide advancement mechanism; however, the operation is singularly step-wise movement of line-guide 46 for each individual depression of foot pedal 20. Holding foot pedal 20 depressed will not result in any more than a single, one line advancement of line-guide 46.

Once the last line of the document has been transcribed, the operator simply manipulates a lever member 76 of release handle 16 downward to disengage release handle 16 and attached line-guide 46 from drive belt 14. The downward manipulation of lever 76 forces a cylindrical hole 78 into axial alignment with cylindrical holes 70. At this point release handle 16 and line-guide 46 are easily slidable to the beginning position. When released, lever 76 is springably urged into a position such that cylindrical hole 78 is forced out of axial alignment with cylindrical holes 70. Since drive belt 14 passes through cylindrical holes 70 and 78, one cylindrical hole being out of axial alignment will cause a clamping grip on drive belt 14. Lever 76 is rotationally biased with respect to a body member 80 of release handle 16 by a hinge spring member 82 such that the rest postion of lever 76 is that position which causes a clamping grip on drive belt 14.

The mechanism which accomplishes the above described adjustment of the line-to-line spacing of the step-wise movement of line-guide 46 is shown in plan view in FIG. 6. As knob 36 is concentrically rotated with respect to drum 34 the relative radial position of the 90 degree projection of wire 52 changes concurrently. The radial position of the 90 degree projection from push/pull cable 18 is in direct relation to the relative position of knob 36 and drum 34. A single, fixed distance urging (pull) on push/pull cable 18 from foot pedal 20 will cause a concurrent fixed rotation of knob 36, drum 34 and housing 28. Drive belt 14 is mounted on housing 28 as on a sheave and a fixed rotation of housing 28 will propel drive belt 14 in a fixed distance, straight-line motion. The motion of drive belt 14 is transferred to line-guide 46 via the clamping engagement of drive belt 14 to release handle 16 and its attachment to line-guide 46. Selecting a different relative position for knob 36 in respect to drum 34 changes the radial position of the 90 degree projection from push-/pull cable 18 and a concurrent change in the amount of rotation of housing 28, drum 34 and knob 36. A change in the amount of rotation of housing 28 will also change the step-wise movement distance of line-guide 46 via a change in the motion of drive belt 14 and release handle 16. Foot pedal 20 has a spring biasing element so that when released from the depressed position foot pedal 20 will return to its normal, resting position. The return of foot pedal 20 to its normal position causes a concurrent movement (push) of wire 52. To avoid the push movement of push/pull cable 18 from affecting the position of line-guide 46 a unique one-way clutch mechanism is placed between drum 34 and housing 28. This one-way clutch mechanism allows drum 34 to impart rotation to housing 28 when a pull movement is effected from push/pull cable 18 and yet will allow slippage of housing 28 with respect to drum 34 when a push movement is effected from push/pull cable 18.

The mechanism which is used to impart unidirectional rotational movement to housing 28 is shown in plan view in FIG. 8. As drum 34 is rotated via a fixed distance urging (pull) by push/pull cable 18 from foot pedal 20, fingers 62 are wedged into an ever narrowing gap formed by flutes 64 and close-fitting cavity 66 of housing 28. To ensure that the fingers 62 are properly wedged into the aforementioned gap, each finger 62 is mounted on an elastic biasing spring member 84 which springably urges fingers 62 to wedgeably engage drum 34 and housing 28. This wedging action of fingers 62 in conjunction with friction between the materials involved, causes housing 28 to rotate along with drum 34. Reverse rotation of drum 34 caused by an opposite urging (push) of push/pull cable 18 will frictionally move fingers 62 into an ever widening gap thereby releasing the wedging action and allowing housing 28 to remain at rest even though drum 34 rotates.

SUMMARY, RAMIFICATION, AND SCOPE

Thus the reader will see that the copyholder line-guide advancement mechanism of the invention provides a simple, highly reliable, lightweight, yet economical device which can be used by persons of almost any age or skill level. In addition, the line-guide advancement mechanism of the invention provides a simple, compact drive mechanism comprising less than twenty total parts which in concert will produce a simple, step-wise movement of the line-guide.

Furthermore, the line-guide advancement mechanism has the additional advantages in that it permits increased operator efficiency by not requiring hand actions away from the transcribing apparatus during document transcription;

it allows a very wide range of spacing selection in the step-wise movement of the line-guide to fully cover the wide disparity of line spacings encountered in written, typed and printed documents;

it provides for minimum overall economic burden by using parts requiring minimal machine tool and assembly set-ups;

it permits assembly, alignment, proof testing and maintanence with ease and minimal mechanical skills, thereby lessening direct labor and user burden;

it provides adaptation to copyholders already existing in the office environment, thereby minimizing the expense to the user and maximizing the utility of the invention;

it provides a solution to the problem of visually keeping track of the information contained on a written, typed or printed document;

While our above description contains many specificities, these should not be construed as limitations on the scope of the invention, but rather as an exemplification of one preferred embodiment thereof. Many other variations are possible. For example a copyholder can be made as an integral part of the invention as may be ascertained from FIG. 1; drive belt 14 needs to be neither continuous nor flexible nor cylindrical, rather it can be a telescoping metallic tube, a thin strand of metallic or plastic stripping, a metallic or fiber cable, etc.; an electric switch type foot pedal may be used in conjuction with an electric linear or rotating device to cause rotation of knob 36, drum 34 and housing 28, etc; drive mechanism 12 can be utilized in such a way as to move a document line-by-line whilst a line-guide or similar line highlighting member remains stationary, etc; the line-guide advancement mechanism as herein described can contain an integral line-guide for use on copyholders as herein described which do not contain a line-guide as an integral portion of their structure, etc.

Accordingly, the scope of the invention should be determined not by the embodiment illustrated, but by the appended claims and their legal equivalents.

We claim:

1. In an improved line-guide advancement mechanism unit for copyholders of the type for holding a document containing information to be transcribed and containing a linearly moveable line-guide for highlighting individual lines of information, the improvement comprising:

a line-guide advancement mechanism unit fixably attachable to said copyholders and their contained line-guide, the unit comprising a rotatable drive mechanism means, said rotatable drive mechanism means operable to move said line-guide in a step-wise linear motion, said rotatable drive mechanism means operable to select the movement distance of the step-wise linear motion of said line-guide, said rotatable drive mechanism means comprising an alignment knob member, a drum member, a housing member and an interposed one-way clutch member, said alignment knob member, said drum member, said housing member and said one-way clutch member are concentrically rotatable, said housing member is also a rotary transmission means, said one-way clutch member comprises finger-like projection members, biasing spring members attached to said finger-like projection members and a non-cylindrical projection engageable into a mating non-cylindrical hole in said drum member of said rotatable drive mechanism means.

2. The line-guide advancement mechanism unit of claim 1 wherein said drum member contains flutes on an outer annulus, said flutes arranged to accept said finger-like projection members of said one-way clutch member.

3. The line-guide advancement mechanism unit of claim 2 wherein said flutes have semi-cylindrical shaped bottoms, said semi-cylindrical shaped bottoms each having their center of curvature coincedent with the connecting points of said biasing spring members and said non-cylindrical projection of said one-way clutch member.

4. The line-guide advancement mechanism unit of claim 3 wherein said alignment knob member and said drum member are concentrically rotatable with respect to one another and rotatable in unison upon urging by a push/pull cable, and wherein said drum member comprises a radial groove and a vernier scale.

5. The line-guide advancement mechanism unit of claim 4 wherein said alignment knob member comprises a semi-circular groove inscribed non-concentrically on a rearward surface.

6. An improved line-guide advancement mechanism for copyholders of the type comprising a platen means for retaining in place a document containing information to be transcribed and a line-guide for highlighting individual lines of information as they are being transcribed, the improvement comprising:

a line-guide advancement mechanism unit fixably attachable to said platen and to said line-guide of said copyholders, the unit comprising a rotatable drive mechanism means, said rotatable drive mechanism means operable to move said line-guide in a step-wise linear motion, said rotatable drive mechanism means operable for selecting the movement distance of the step-wise linear motion of said line-guide, said rotatable drive mechanism means comprising an alignment knob member, a drum member, a housing member and an interposed one-way clutch member, said alignment knob member, said drum member, said housing member and said one-way clutch member are concentrically rotatable, said housing member is also a rotary transmission means, wherein said alignment knob member and said drum member are concentrically rotatable with respect to one another and rotatable in unison upon urging by a push/pull cable, and wherein said drum member comprises a radial groove and a vernier scale.

7. The line-guide advancement mechanism unit of claim 6 wherein said one-way clutch member comprises finger-like projection members, biasing spring members attached to said finger-like projection members and a non-cylindrical projection engageable into a mating non-cylindrical hole in said drum member of said rotatable drive mechanism means.

8. The line-guide advancement mechanism unit of claim 7 wherein said alignment knob member comprises a semi-circular groove inscribed on a rearward surface.

* * * * *